US006394452B1

(12) United States Patent
Dunne

(10) Patent No.: US 6,394,452 B1
(45) Date of Patent: May 28, 2002

(54) THREE-DIMENSIONAL NOUGHTS AND CROSSES TYPE OF GAME

(76) Inventor: Stephen Terence Dunne, The Cottage Great Finborough, Stowmarket, Suffolk (GB), IP 14 3AE ( * ) Notice: Subject to any disclaimer, the term of this patent is extended or adjusted under 35 U.S.C. 154(b) by 0 days.

(21) Appl. No.: 09/530,861

(22) PCT Filed: Nov. 4, 1998

(86) PCT No.: PCT/GB98/03307

§ 371 (c)(1),
(2), (4) Date: Jun. 16, 2000

(87) PCT Pub. No.: WO99/24129

PCT Pub. Date: May 20, 1999

(30) Foreign Application Priority Data

Nov. 7, 1997 (GB) ..... 9723449

(51) Int. Cl.[7] ..... A63F 3/02; A63F 3/00
(52) U.S. Cl. ..... 273/241
(58) Field of Search ..... 273/241, 271

(56) References Cited

U.S. PATENT DOCUMENTS

| | | | | | |
|---|---|---|---|---|---|
| 2,880,001 | A | * | 3/1959 | Rosenzweig | 273/241 |
| 2,940,760 | A | * | 6/1960 | Brinkman, Jr. | 273/241 |
| 3,606,333 | A | * | 9/1971 | Green | 273/241 X |
| 3,623,729 | A | * | 11/1971 | Wetherell | 273/241 |
| 3,888,487 | A | * | 6/1975 | Replogle | 273/241 |
| 4,129,303 | A | * | 12/1978 | Flagg | 273/241 |
| 4,440,395 | A | * | 4/1984 | Hyland et al. | 273/241 |
| 4,535,993 | A | * | 8/1985 | Topits | 273/241 |

* cited by examiner

*Primary Examiner*—Raleigh W. Chiu
(74) *Attorney, Agent, or Firm*—Bracewell & Patterson, LLP

(57) ABSTRACT

The present invention relates to a three-dimensional noughts and crosses game in which games pieces are placed in attachment means located at the apexes, lines of intersection and upon the generally planer surfaces of a body member, notably a solid or hollow cube, so as to create lines of games pieces which extend in three dimensions across the junction of at least two of the surfaces of the cube.

5 Claims, 2 Drawing Sheets

THREE-DIMENSIONAL NOUGHTS AND CROSSES TYPE OF GAME

The present invention relates to a game, notably to a three dimensional noughts and crosses type of game.

BACKGROUND TO THE INVENTION

Noughts and crosses, or tic-tac-toe as it is also known, is a game in which two opponents each try to complete a line of three or more noughts or crosses on a grid layout, whilst at the same time preventing the opponent from completing a line, by each in turn entering a nought or cross respectively on the grid. There are a number of variations of this game, but each requires a line of a specified number of either noughts or crosses (or other pairs of symbols) to be completed. For simplicity, the invention will be described hereinafter in terms of the completion of lines of noughts or crosses.

In order to make the game more challenging, it has been proposed to play the game in three dimensions on three or more layers, each having receptacles laid out in a grid pattern and adapted to receive a coloured marble or other game piece. However, such truly three dimensional games are cumbersome and often complex to play.

I have now devised a simplified form of such a three dimensional game which is compact and simple to play and yet provides a wide number of permutations of play.

SUMMARY OF THE INVENTION

Accordingly, the present invention provides a game comprising the combination of:

a. a polygonal three dimensional body member having at least four exposed contiguous planar surfaces which surfaces intersect along lines of intersection which lines terminate at each end thereof in an apex where three or more of said surfaces intersect;

b. a plurality of games piece anchorage points provided on or in association with at least three of said surfaces, each anchorage point being adapted to receive and locate a games piece upon said body member in specified geometric relationship to other games pieces, an anchorage point being located at each of at least three of said apices, at least one anchorage point being located upon each of at least three of said lines of intersection, and at least one anchorage point being located upon each of at least three of said surfaces; and c. at least two series of games pieces adapted to be received by said anchorage points.

Preferably, the anchorage points are located symmetrically upon the body member and all exposed surfaces of the body member are provided with at least one anchorage point.

The body member may be of any suitable shape and size. The exposed faces may thus be of triangular, square, trapezium, hexagon, octagon or other shape. However, it is preferred that the surfaces be of equilateral shape, notably square, hexagon or octagon shape so that the body presents a series of uniform surfaces and has symmetry in all three axes so that the game can be played with the body in any orientation. Preferably, the body is a right pyramid, a cube or a right octahedron or dodecahedron.

For convenience, the invention will be described hereinafter in terms of a cube body member.

Such a body member has six exposed faces and, preferably, all six faces are available for use in playing the game. However, if desired, one face may be excluded as being the base face upon which the cube rests and, as such, is not an exposed face for the purposes of playing the game as described below. Each face presents a right square surface which intersects with two adjacent faces to form a corner of the cube. That corner is an apex of the body member and there are eight such apices to the cube. Two adjacent surfaces intersect along the lines linking each at the apices to an adjacent apex to form the side walls of the cube and each cube has six side walls, including the top and bottom walls of the cube. Each wall can be of any suitable size and colour, but will typically be from 2.5 to 10 cms square. If desired, the wall may be dished inwardly or outwardly to provided an aesthetic shape to the body member, in which case the lines of intersection of the exposed surfaces will be curved rather than straight. For convenience, the invention will be described hereinafter in terms of a cube having substantially flat wall surfaces.

The surfaces can be the exposed surfaces of a solid body, for example a die cast, extruded or other moulded plastic cube or a machined wooden or metal cube. However, the cube may be a hollow member made by linking together six flat square panels of a suitable material to form the side walls of the cube. If desired, such a hollow cube can be made by snap fitting the wall panels to one another using suitable securing means along each edge of the panel, or by means of a stem or cup extending normal to the plane of the panel and engaging with a central support spider member located within the resultant cube. In a particularly preferred embodiment, the cube is formed in two halves as hollow mouldings which are a snap fit engagement on one another to form the complete cube. For convenience, the invention will be described hereinafter in terms of a solid cube.

The cube is provided with anchorage points by which games pieces can be secured to the body member. These anchorage points can take a wide range of forms, depending upon the nature of the games piece used. Thus, the anchorage point may take the form of a metal disc or the like where the games piece is provided with a magnetic foot or vice versa; or where, the cube is made from a ferro-magnetic material, the anchorage point can take the form of a break in the paint or other surface finish to the cube which identifies the position at which such a magnetic games piece is to be affixed to the cube. The anchorage point may take other forms, for example a disc of the hooked portion of a hook and eye type fastening, the games piece carrying the corresponding eye portion; or vice versa. However, it is preferred to provide the anchorage by means of the push fit engagement of a stem carried by the games piece in a socket or recess in the body member or vice versa. The game piece may be locked in position by means of a bayonet type mounting, but a friction push fit is usually satisfactory.

For convenience, the invention will be described hereinafter in terms of a games piece having a shank piece which is a friction push fit into a socket in the body member. Such inter-engaging shanks and sockets can be of any suitable size and depth. If desired, where the cube is made from a series of panel members, the shank can carry a radially extending pin or lug and the socket can have a corresponding radial slot so that the shank and its pin can pass through the aperture in the panel provided by the recess. The games piece can then be locked in position by twisting the games piece about the longitudinal axis of the shank to carry the radial pin out of register with the radial slot. Alternatively, the sockets can carry circumferential ribs which engage radial ribs on the shank of the games piece to provide a snap fit or screw fit locking of the shank in the socket. The shank and the socket are preferably of a generally circular cross section. However, they may have other forms, for example a squared or triangular cross section, so that the games piece adopts a fixed orientation with respect to the body member once the stem has been engaged in the socket.

For convenience, the invention will be described hereinafter in terms of a body member carrying a plurality of circular sockets into which the cylindrical shanks of pins carried by the games pieces engage as a friction push fit.

The game of the invention is characterised by the layout of the anchorage points upon the body member. It has been proposed in U.S. Pat. No. 4,129,303 to form a solid cube and to provide games piece anchorage points upon the surfaces of the cube. The anchorage points, are laid out in a conventional grid pattern on each exposed face of the cube with playing lines joining the anchorage points extending from one face onto an adjacent face. However, none of the anchorage points are located at the apices of the cube or on the lines at which one wall of the cube intersects another. In the present invention, by locating the anchorage points at the apices of the body member and at least one on each line of intersection between adjacent faces of the cube, games pieces may be positioned on the body member at positions at which they can form continuous lines with games pieces located upon two or more adjacent exposed surfaces. In the case of anchorage points located at the apices of the body member, games pieces located in them can form part of lines of games pieces extending along any one of the adjacent lines of intersection and/or onto any one of the adjacent exposed faces. As a result, there is a greater number of possible lines which can be completed as compared to a cube where the games pieces can be located only in anchorage points within the plan area of each exposed face. In a particularly preferred embodiment of the invention, anchorage points are located one at each apex, one midway along each line of intersection and one centrally upon each exposed surface so as to provide nine possible anchorage points to each exposed face of the body, with possible line of games pieces extending from one exposed face to an adjacent exposed face, extending along a line of intersection and/or onto an adjacent line of intersection via an apex or any combination thereof. If desired, instead of a three by three grid pattern for the locations of the anchorage points as just described, the grid pattern may be asymmetric, for example three by four, or may contain more than three points, for example a four by four or five by five grid pattern.

For convenience, the invention will be described hereinafter in terms of the preferred three by three grid layout just described.

The anchorage points are preferably all the same so that any games piece can be attached to any anchorage point. However, if desired, the anchorage points may be of different types, as when extra points/rewards are awarded for using an apical anchorage point in a larger layout game. It is also preferred that the exposed faces of the body member all be the same, although they may be of different colours and/or surface textures so that initially only certain games pieces can be attached to a given exposed face so as to provide additional complexity to the game.

The games typically involves attaching two series of games pieces to the body member by two players in alternate turns in an attempt to create a line of four or more similar games pieces, whilst at the same time blocking a line being created by the opponent. The series of games pieces can take a wide range of forms, for example mushroom tops of different colours, pieces with round or cruciform heads or other more complex shapes. As stated above, the games pieces are typically in the form of a pin or stem carrying a distinctive head. If desired, three or more players may play the game simultaneously using the requisite number of different series of games pieces.

As stated above, the invention can be applied to a noughts and crosses type game in which players attempt to create a line of their games pieces whilst blocking anchorage points which would enable their opponent to create a line of games pieces. The invention may be applied to variations of such a game, for example where a cross is to be created by two intersecting lines or where more than one line is to be created on a body member carrying more than a three by three grid pattern of anchorage points. The game may also involve capture and/or removal of opponents games pieces as with draughts or Othello, the jumping of opponents games pieces as with Chinese Chequers, and the upgrading of games pieces when certain positions on the body member are occupied as in Draughts. The invention can be applied to a wide range of such games and is not limited to noughts and crosses. Furthermore, the games may involve more than two players or may be played by a sole player.

Whilst the invention has been described above in terms of a game in which two players attach games pieces openly to the body member so that one player can see what attachments have been made by the other player, the invention may be applied to games in which games piece attachments are carried out without the other player being able to see what attachments have been made until a later stage of the game. To this end, it may be desirable to provide the body member with clip on or otherwise removable shields which screen surfaces on the body member from view by an opponent.

DESCRIPTION OF THE DRAWINGS

A particularly preferred embodiment of the game of the invention will now be described by way of illustration with respect to the accompanying drawings in which.

DESCRIPTION OF THE PREFERRED EMBODIMENT

Figure 3:
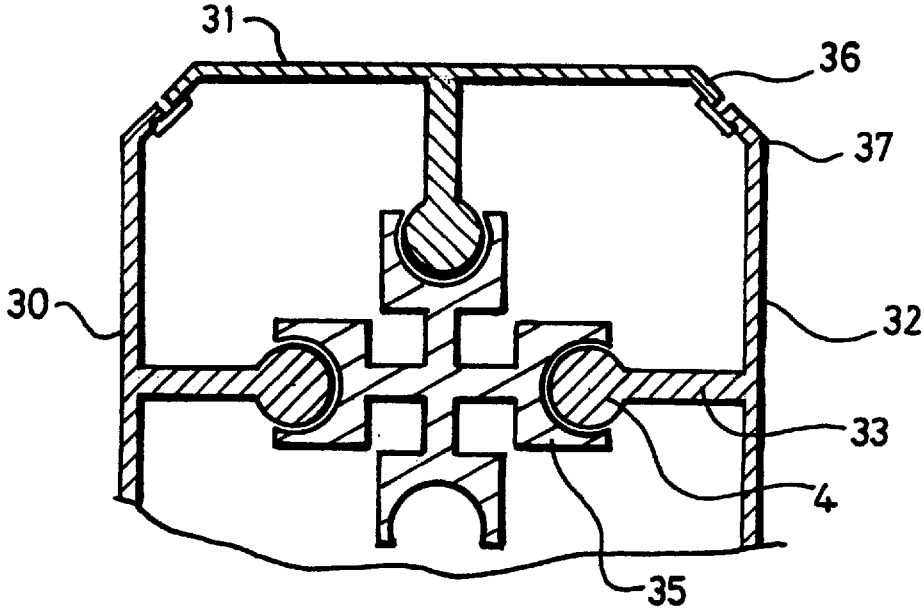
FIG. 3 is a diagrammatic cross-section through the cube of FIG. 1 showing one form of construction of the cube.

The body member comprises a cube 1 having a series of exposed square faces 2, 3, 4, etc. The cube can be machined from a solid block or can be made from a series of interengaging square panels. As shown in FIG. 3, these panels 30, 31, 32 can each carry an inwardly directed arm 33 terminating in a ball 34. The balls 34 are a snap fit in a central spider 35 so that the rim 36 of each panel bears against the rim 37 of an adjacent panel to form a smooth cuboid body.

Figure 1:
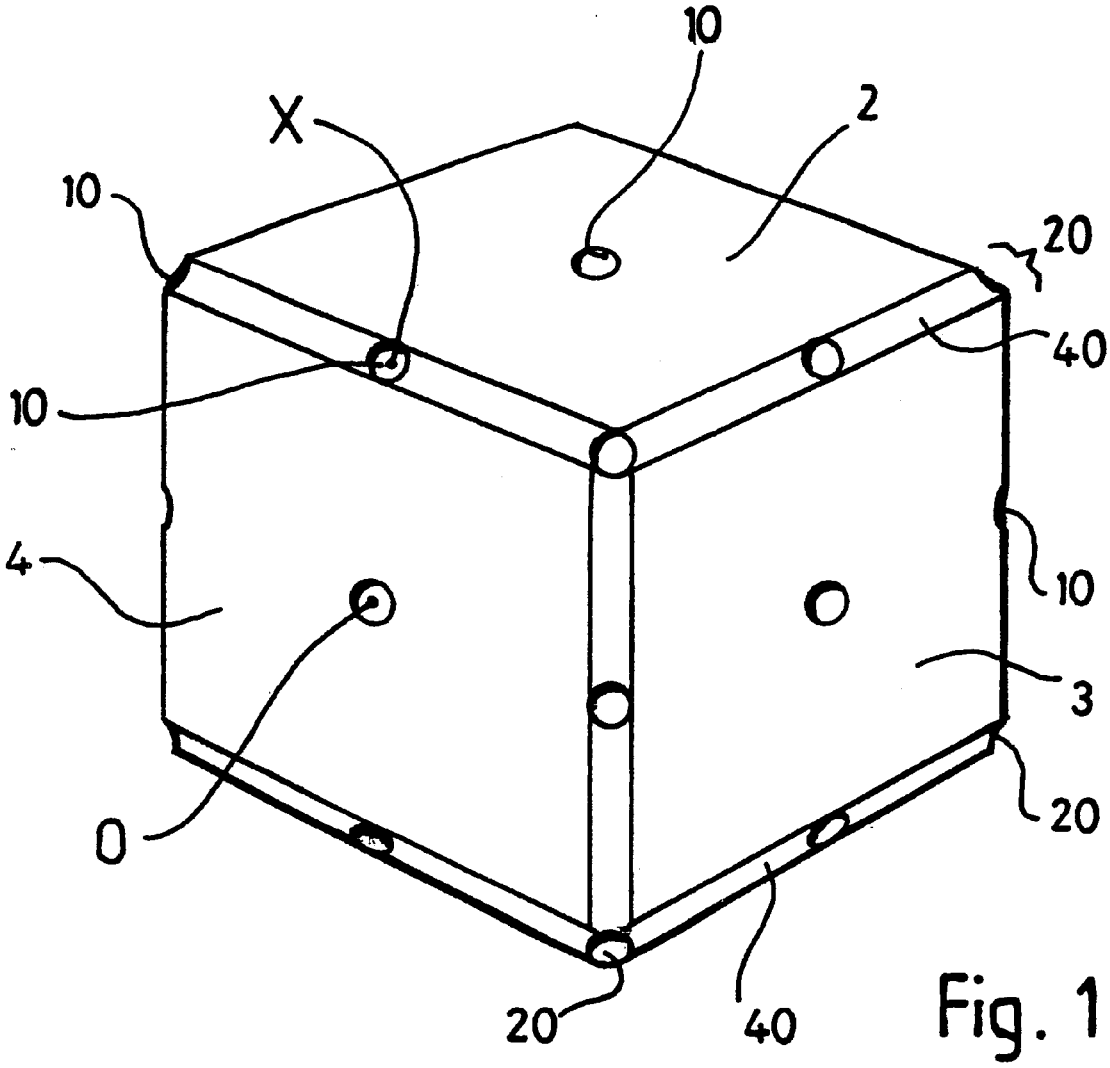
FIG. 1 is a perspective view of a cube carrying the anchorage points as a three by three grid pattern.
Figure 2:
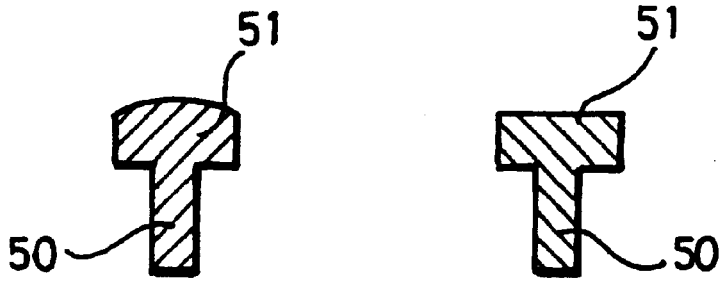
FIG. 2 is a diagrammatic elevational view of two forms of games piece for use with the cube of FIG. 1.

Each face 1, etc carries a number of anchorage points 10, both substantially centrally upon the face and symmetrically located about the periphery of the face on the apices 20 of the cube and along the lines of intersection 40 of adjacent faces. These anchorage points are simple cylindrical bores or apertures in the surfaces of the cube 1 directed towards the centre point of the cube. If desired, the apices 20 and the lines of intersection 40 can be flattened to provide a planar surface around the anchorage points 10 as shown in FIG. 1. Where the cube is formed from a series of abutting panels 30, etc, the anchorage points 10 are formed as semi-circular indentations around the periphery of each panel so that they register with corresponding indentations on adjacent panels when the cube is assembled to form the anchorage point 10. As shown in FIG. 1, the anchorage points 10 are located on a three by three grid with points located at each apex 20 of the cube, centrally along each line of intersection 40 between adjacent faces of the cube and centrally upon each exposed face of the cube to provide a total of twenty six anchorage points upon all six surfaces of the cube.

The playing pieces comprise a stem 50 which is a push fit within the bores of the anchorage points 10. At least two series of playing pieces are provided, each being distinguished by the shape and/or colour of the head 51 carried by the stem 50.

In playing the game, a first player inserts the stem 50 of a playing piece from the first series into the bore of the anchorage point X at the centre of one of the lines of intersection 40. This is to ensure that the first player can be defeated by his opponent. The opponent then anchors a playing piece from the second series in another anchorage point; and so on in alternate moves until one player wins by completing a line of four pieces, at least one of which in located in the anchorage point O in the centre of one of the exposed faces of the cube; or all the anchorage points have been filled without either player creating a line—a draw.

Figure 4:
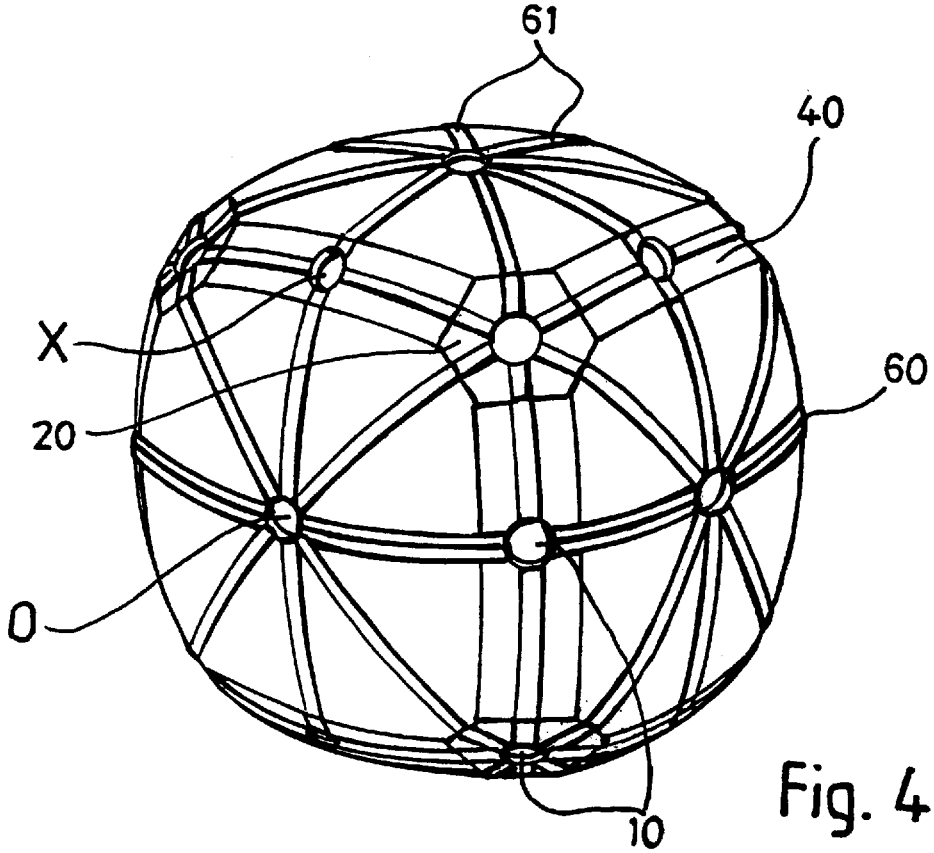
FIG. 4 is a perspective view of a cube formed from two hollow halves and having outwardly convex faces to the cube.

In the form of cube shown in FIG. 4, the exposed faces of the cube are outwardly convex as shown and the cube is formed by snap fitting together two hollow halves of the cube. The joint between the top and bottom halves is shown as circumferential line 60 around the waist of the cube. The start point for the game is identified as anchorage point X. If desired, the lines which each player can build up with his games pieces can be identified on the surfaces of the cube, for example as scored or painted lines. Alternatively, as shown in FIG. 4, the lines can be identified by raised lines 61 moulded into the surface of the cube during its manufacture.

The cube 1 and the playing pieces 50/51 can be made from any suitable materials, for example an extruded or injection moulded plastic. If desired, the heads 51 of the playing pieces can be made from wood or metal, and the stems 50 from another material, for example plastic, to provide visual variety to the games pieces.

What is claimed is:

1. A method of playing a game in which a player attaches playing pieces to anchorage points in specified geometric arrangement relative to one another on the external surfaces of the body member with the objective of completing a line of playing pieces extending across the surface of the body member, wherein:

a. the body member is a cube body member having six exposed contiguous planar side faces, which faces intersect along twelve lines of intersection, which lines terminate at each end thereof in an apex where three of said faces intersect to provide eight apices; and b. the anchorage points are provided externally upon said body member, each anchorage point being adapted to receive and locate a games piece externally upon said body member in specified geometric relationship with respect to other games pieces attached to the body member; and c. a single anchorage point is located at each of said eight apices; each of the side faces carries a sole anchorage point which is located substantially centrally upon the side face; and a single anchorage point is located substantially midway along each of said twelve lines of intersection;

characterised in that d. the objective of the game is for a player to complete a row of four games pieces extending over at least two surfaces of the body member in competition to the other players by attaching playing pieces to the anchorage points on the body member in successive turns with the other players; and e. all the anchorage points are located solely externally upon the body member.

2. A method as claimed in claim 1, characterised in that two players play the game by attaching games pieces in alternate turns to the anchorage points of the body member.

3. A method as claimed in claim 2, which involves the capture and removal by one player of playing pieces attached to the body member by the other player.

4. A method as claimed in claim 2, which involves the jumping of the other player's playing pieces.

5. A method as claimed in claim 2, which involves the upgrading of a playing piece when certain anchorage points on the body member are occupied by that playing piece.

* * * * *